US009327924B2

(12) United States Patent
Ishikura

(10) Patent No.: US 9,327,924 B2
(45) Date of Patent: May 3, 2016

(54) SHEET CONTAINING DEVICE AND IMAGE FORMING APPARATUS

(71) Applicant: Oki Data Corporation, Tokyo (JP)

(72) Inventor: Hiroki Ishikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/608,259

(22) Filed: Jan. 29, 2015

(65) Prior Publication Data

US 2015/0298921 A1 Oct. 22, 2015

(30) Foreign Application Priority Data

Jan. 31, 2014 (JP) ..... 2014-016400

(51) Int. Cl.
*B65H 1/04* (2006.01)
*B65H 9/00* (2006.01)
*B65H 31/20* (2006.01)

(52) U.S. Cl.
CPC .. *B65H 1/04* (2013.01); *B65H 9/00* (2013.01); *B65H 31/20* (2013.01); *B65H 2405/10* (2013.01); *B65H 2405/114* (2013.01); *B65H 2405/1122* (2013.01); *B65H 2405/1144* (2013.01); *B65H 2511/11* (2013.01); *B65H 2511/12* (2013.01); *B65H 2801/06* (2013.01); *B65H 2801/39* (2013.01)

(58) Field of Classification Search
CPC ..... B65H 1/00; B65H 1/04; B65H 31/20; B65H 2405/10; B65H 2405/1122; B65H 2405/114; B65H 2405/1144; B65H 2511/11; B65H 2511/12; B65H 9/00
USPC ..... 271/171, 223
See application file for complete search history.

(56) References Cited

U.S. PATENT DOCUMENTS 6,409,165 B1 * 6/2002 Yamaoka ..... B65H 1/12 271/127
8,128,084 B2 * 3/2012 Kitayama ..... B65H 1/266 271/145

(Continued)

FOREIGN PATENT DOCUMENTS

JP H11-139576 A 5/1999
JP 2011-201703 A 10/2011

*Primary Examiner* — David H Bollinger
(74) *Attorney, Agent, or Firm* — Panitch Schwarze Belisario & Nadel LLP

(57) ABSTRACT

A sheet containing device of the invention includes a sheet containing unit for containing a sheet, a regulation member arranged movably in a prescribed moving direction for regulating a position of the sheet contained in the sheet containing unit, a first engaging portion provided at the regulation member, and a first engaged portion provided at the sheet containing unit for holding the regulation member at plural holding positions by engaging the first engaging portion. One of the first engaging and engaged portions has plural engagement grooves arranged with first intervals, and the other of the first engaging and engaged portions has plural engagement projections arranged with second intervals engageable with the plural engagement grooves. An interval of the plural holding positions is equal to the first interval whereas the second interval is an integral multiplication equal to or greater than two of the first interval.

22 Claims, 9 Drawing Sheets

(56) References Cited

U.S. PATENT DOCUMENTS

2003/0127364 A1* 7/2003 Salomon ..... B65H 1/06 209/1
2006/0222434 A1* 10/2006 Kitamura ..... B65H 1/04 400/624
2008/0001346 A1* 1/2008 Meetze ..... B65H 1/04 271/171
2009/0236796 A1* 9/2009 Chino ..... B41J 13/10 271/171
2010/0052247 A1* 3/2010 Kaseda ..... B65H 1/266 271/226
2010/0270735 A1* 10/2010 Allwright ..... B65H 1/266 271/171
2012/0056370 A1* 3/2012 Kobayashi ..... B65H 1/266 271/250

* cited by examiner

SHEET CONTAINING DEVICE AND IMAGE FORMING APPARATUS

CROSS REFERENCE TO RELATED APPLICATIONS

This application claims priority benefits under 35 USC, section 119 on the basis of Japanese Patent Application No. 2014-016400, the disclosure of which is incorporated herein by reference.

BACKGROUND OF THE INVENTION

1. Field of the Invention

This invention relates to a sheet containing device and an image forming apparatus.

2. Description of Related Art

Japanese Patent Application Publication No. 2011-201,703 (A1) discloses a medium stacking apparatus including a medium stacking unit stacking media and a guide member provided movably with respect to the medium stacking unit for regulating ends of the media. With this medium stacking apparatus, the guide member is secured to a prescribed position of the medium stacking unit upon engagement between plural locking projections formed at the guide member and plural locking projections formed on a bottom of the medium stacking unit.

In Japanese Patent Application Publication No. Hei 11-139,576 (A1), a sheet material feeding apparatus is disclosed in having an intermediate plate stacking sheet materials and a rear end regulation plate regulating the rear ends of the sheet materials stacked on the intermediate plate. With this sheet material feeding apparatus, a guide member having a rack is attached to the intermediate plate, and a lever having a rack is attached to the rear end regulation plate. The rack of the lever meshes the rack of the guide member by an urging spring, thereby locking the rear end regulation plate at a favorite position on a pitch unit basis of the racks. One end of the urging spring is structured to face recesses on the guide member in an engageable manner with elasticity, so that when the rear end regulation plate is made to slide, click feeling notifies the user of the locking positions of the standard sizes upon entry of the spring rear end into the recesses.

With the sheet containing apparatus having a sheet containing unit containing sheets such as, e.g., paper, a regulation member arranged movably with respect to the sheet containing unit for regulating the positions of the sheets, and a mechanism holding the position of the regulation member, however, it is desirable to reduce a load when releasing the holding state of the regulation member. For example, with the art set forth in the above Publication No. 2011-201,703, the locking projections have a large contact area and suffer from a large load when disengaged, because the plural locking projections formed at the guide member and the plural locking projections formed at the medium stacking unit are corresponding to each other one by one.

It is an object of the invention to provide a sheet containing device capable of reducing a load when releasing a holding state of a regulation member regulating the position of the sheets contained in a sheet containing unit, and an image forming apparatus including such a sheet containing device.

SUMMARY OF THE INVENTION

To solve the above problems, a sheet containing device according to a first aspect of the invention comprises: a sheet containing unit for containing a sheet; a regulation member arranged movably in a prescribed moving direction with respect to the sheet containing unit for regulating a position of the sheet contained in the sheet containing unit in the moving direction; a first engaging portion provided at the regulation member; and a first engaged portion provided at the sheet containing unit for holding the regulation member at plural holding positions in the moving direction by engaging the first engaging portion, wherein one of the first engaging portion and the first engaged portion has a plurality of engagement grooves arranged with first intervals in the moving direction, wherein the other of the first engaging portion and the first engaged portion has a plurality of engagement projections arranged with second intervals in the moving direction, the engagement projections engaging the plural engagement grooves, and wherein an interval of the plural holding positions is equal to the first interval whereas the second interval is an integral multiplication equal to or greater than two of the first interval.

In accordance with a second aspect of the invention, a sheet containing device comprises: a sheet containing unit for containing a sheet; a regulation member arranged movably in a prescribed moving direction with respect to the sheet containing unit for regulating a position of the sheet contained in the sheet containing unit in the moving direction; first and second engaging portions provided at the regulation member; and first and second engaged portions provided at the sheet containing unit for holding the regulation member at plural holding positions in the moving direction by engaging the first and second engaging portions, respectively, wherein the first and second engaging portions are structured so that after the first engaging portion disengages from the first engaged portion according to movement of the first engaging portion in a direction apart from the first engaged portion upon reception of external force, the second engaging portion moves in a direction apart from the second engaged portion upon receiving force of the movement of the first engaging portion to disengage the second engaging portion from the second engaged portion.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF EMBODIMENTS

Selected embodiments of the present invention will now be explained with reference to the drawings. It will be apparent to those skilled in the art from this disclosure that the following descriptions of the embodiments of the invention are provided for illustration only and not for the purpose of limiting the invention as defined by the appended claims and their equivalents.

Figure 1:
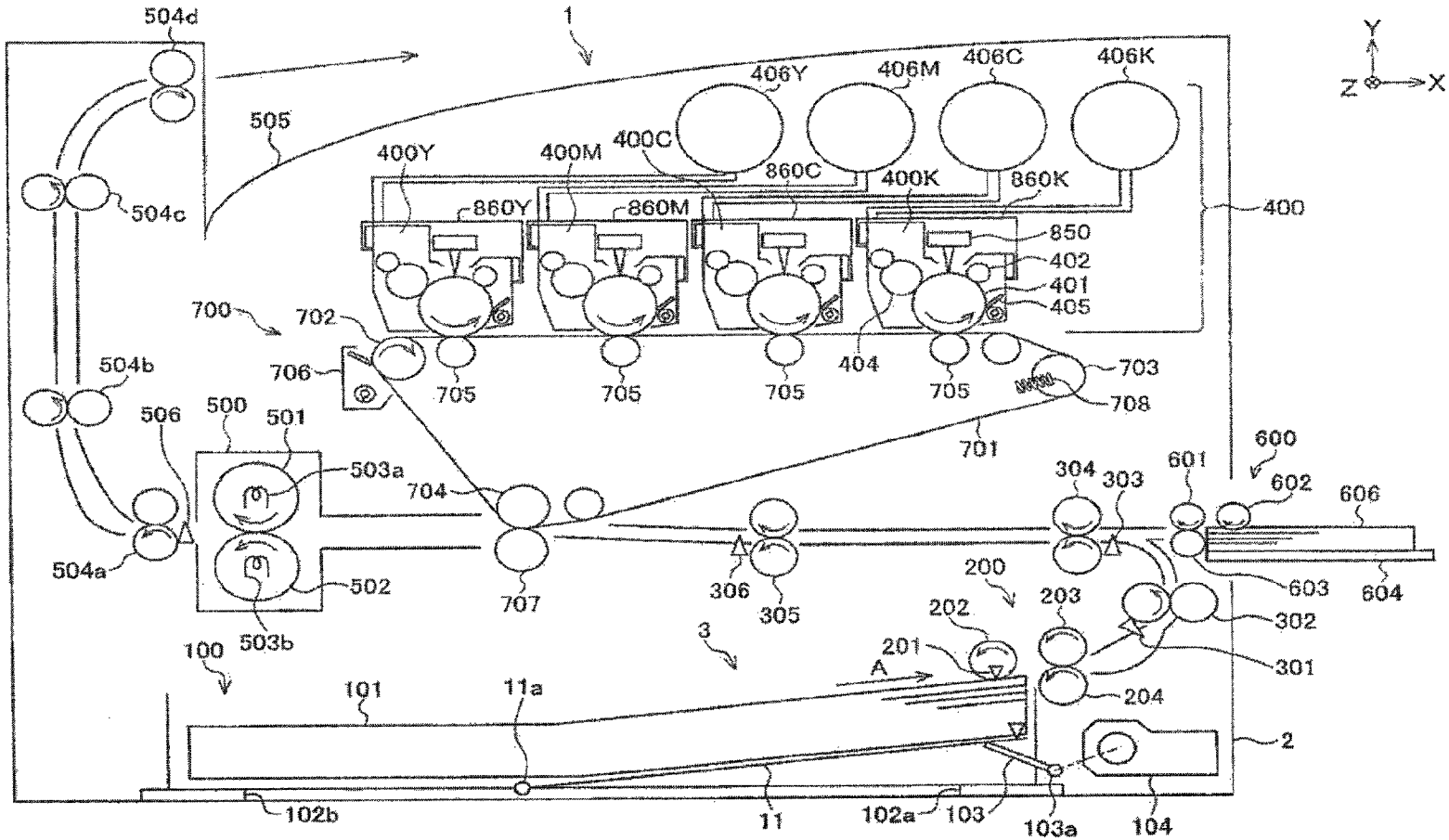
FIG. 1 is a schematic illustration showing a structure of an image forming apparatus including a sheet containing apparatus according to an embodiment of the invention.

FIG. 1 is a schematic illustration showing a structure of an image forming apparatus 1 including a sheet containing apparatus according to this embodiment. The image forming apparatus 1 is an apparatus forming images on a sheet contained in a sheet containing apparatus. The image forming apparatus 1 is a multicolor printer of an electrophotographic method in this embodiment.

The image forming apparatus 1 includes a paper cassette 100 as a sheet containing device for containing sheets, a paper feeding unit 200 as a sheet feeding unit for feeding out the sheets contained in the paper cassette 100, and an image forming unit 400 forming images on the sheet fed out of the paper feeding unit 200.

The paper cassette 100 contains a printing medium or printing paper 101 as a sheet (hereinafter referred to as simply "paper"). More specifically, the paper 101 is placed in a stacked state inside the paper cassette 100. The paper cassette 100 is detachably attached to an apparatus body, and a lower end of the cassette is supported by stable bases 102*a*, 102*b*. A paper loading plate 11 is formed pivotally around a supporting axis 11*a*, inside the paper cassette 100, and the paper 101 is placed in a stacking manner on the paper loading plate 11. A lift-up lever 103 is provided on a feeding out side of the paper cassette 100 in a manner rotatable around a supporting axis 103*a*, and the supporting axis 103*a* engages a motor 104 in a connecting and disconnecting manner. When the paper cassette 100 is inserted into the apparatus body 2, the lift-up lever 103 and the motor 104 come to engage each other, and a control unit, not shown, drives the motor 104. With this operation, the lift-up lever 103 rotates to elevate a bottom of the paper loading plate 11 with a tip of the lift-up lever 103, thereby lifting up the paper 101 stacked on the paper loading plate 11. When the paper 101 is lifted up to a certain level, the paper 101 contacts a pickup roller 202, and a lift-up detection unit 201 detects this contact. The control unit stops the motor 104 based on information that the lift-up detection unit 201 detects. The pickup roller 202 constitutes the paper feeding unit 200 together with a feed roller 203 and a retard roller 204 disposed as a pair in a contacting state. The paper feeding unit 200 constitutes a paper feeding device 3 together with the paper cassette 100.

The pickup roller 202 and the feed roller 203 are driven to rotate in an arrow direction in FIG. 1 by a motor not shown, and is able to idle in the arrow direction when its rotational drive is stopped because of having a one-way clutch mechanism, not shown, inside. The retard roller 204 generates a torque in the arrow direction with a torque generating means not shown. The pickup roller 202 therefore picks up the contacting paper 101 out of the paper cassette 100, and the feed roller 203 and the retard roller 204 feed out the paper 101 sheet by sheet sequentially into the conveyance route even where plural sheets of the paper 101 are pulled out at the same time.

Disposed on a downstream side of the paper feeding unit 200 in the conveyance direction (arrow A direction in FIG. 1) of the paper 101 are, sequentially, a paper sensor 301, a conveyance roller pair 302 regulating skew of the paper 101, a paper sensor 303 detecting a drive timing of a subsequent conveyance roller pair 304, the conveyance roller pair 304 and a conveyance roller pair 305 for feeding the paper 101 to the image forming unit 400, and a writing sensor 306 for measuring a writing timing at the image forming unit 400. A conveyance motor or motors, not shown, transmit power to those conveyance roller pairs 302, 304, 305 via drive transmission means such as gears not shown.

A multipurpose tray (MPT) 600 for feeding paper 606 stacked on the paper loading plate 604 is provided on a right side surface of the image forming apparatus 1 shown in FIG. 1. The MPT 600 includes the paper loading plate 604 stacking the paper 606, a pickup roller 602 feeding out the paper 606 in contact with the paper 606, a feeding roller 601 for feeding the fed paper 606 to the conveyance route of the apparatus body 2, and a retard roller 603 urged and contacted with the feeding roller 601 for separating the fed paper 606 sheet by sheet.

The image forming unit 400 has four process units 400Y, 400M, 400C, 400K respectively forming images in respective colors of yellow, magenta, cyan, and black, and those units are arranged above an intermediate transfer belt unit 700. The process unit 400K for black is exemplified to describe an internal structure of the process units because the internal structures of those process units are common.

The process unit 400K is provided with a photosensitive drum 401 disposed rotatably in an arrow direction, and in a periphery of the photosensitive drum 401, is arranged with, according to an order from an upstream side in the rotational direction, a charge roller 402 supplying charges to and charging a surface of the photosensitive drum 401, and an exposure device 850 selectively radiating light to the surface of the charged photosensitive drum 401 to form electrostatic latent images on the surface. Further disposed on the surface of the photosensitive drum 401 formed with the electrostatic latent images are a developing roller 404 forming toner images upon attaching black toner, and a drum cleaning unit 405 removing transfer remaining toner remaining when the toner images on the photosensitive drum 401 are transferred. A toner containing unit 406K collects the toner and supplies the toner to the developing roller 404. The drum and rollers contained in this process unit 400K rotate according to drive power transmitted from a drive source, not shown, via such as gears.

An intermediate transfer belt unit 700 transfers the toner images formed by the image forming unit 400 to the paper 101 supplied from the paper cassette 100 or the paper 606 supplied from the MPT 600. The intermediate transfer belt unit 700 includes an intermediate transfer belt 701, a drive roller 702 driven by a drive unit not shown, a tension roller 703 providing tension to the intermediate transfer belt 701 upon urged by a urging member 708 such as, e.g., a coil spring, a secondary transfer backup roller 704 disposed inside the intermediate transfer belt 701, and a secondary transfer roller 707 disposed facing the secondary transfer backup roller 704 in sandwiching the intermediate transfer belt 701. The intermediate transfer belt 701 is tensioned with the drive roller 702, the tension roller 703, and the secondary transfer backup roller 704, and is driven by the drive roller 702. The intermediate transfer belt 701 further includes four primary transfer rollers 705 disposed facing the photosensitive drum 401 of each process unit in sandwiching the intermediate transfer belt 701, and a belt cleaning unit 706 removing toner remaining on the intermediate transfer belt 701. With the structure above, the four primary transfer rollers 705 transfer the toner images formed on the corresponding photosensitive drum 401 to the intermediate transfer belt 701 in application of a prescribed voltage, and the secondary transfer roller 707 transfers the toner images in the respective colors transferred to the intermediate transfer belt 701 further to the paper 101 or the paper 606. The paper 101 or the paper 606 to which the toner images are transferred is conveyed to a fixing unit 500.

The fixing unit 500 includes a roller pair made of an upper roller 501 having a surface formed of an elastic body and having inside a halogen lump 503*a* serving as a heat source, and a lower roller 502 having a surface formed of an elastic body and having inside a halogen lump 503*b* serving as a heat source. The fixing unit 500 melts the toner images in application of heat and pressure on the toner images formed on the paper 101 or the paper 606 fed out of the image forming unit 400, and fixes the images on the paper 101 or the paper 606.

The paper 101 or the paper 606 having the toner images fixed is conveyed by delivery roller pairs 504*a*, 504*b*, 504*c*, 504*d*, and is delivered to a stacker unit 505. Those delivery rollers receive drive force from a drive source not shown via a drive transmission means not shown. A paper sensor 506 disposed at an output unit of the fixing unit 500 detects drive timings of the delivery roller pairs 504*a*, 504*b*, 504*c*, 504*d*.

As shown in FIG. 1, a Z-axis is provided in a direction perpendicular to the conveyance direction of the paper 101 (arrow A direction in FIG. 1) and parallel to the surface of the paper 101 in the paper cassette 100; a Y-axis is provided in an up and down direction of the paper cassette 100, or namely, a direction stacking the paper 101; a X-axis is provided in a direction perpendicular to both of the Z-direction and the Y-direction. The X, Y, and Z-axes are also shown in other drawings. In the following description, directions parallel to X, Y, and Z-axes are set to X-direction, Y-direction, and Z-direction, respectively. With respect to the X-directions, a direction on a conveyance direction side of the paper 101 is set to +X-direction, the opposite direction of which is set to −X-direction. With respect to the Y-directions, an up direction is set to +Y-direction whereas a down direction is set to −Y-direction. With respect to the Z-directions, a direction in which the paper cassette 100 is inserted into the apparatus body 2, or namely a direction on a left end side of the paper 100 in the paper cassette 100 is set to +Z-direction, the opposite direction of which is set to −Z-direction.

Figure 2A:
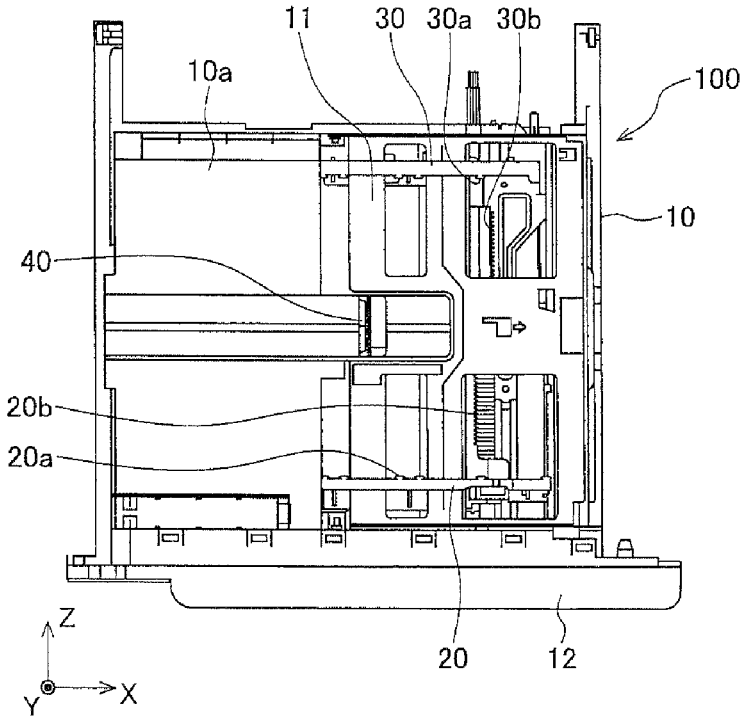
FIGS. 2A, 2B are a plan view and a perspective view, respectively, showing a feeding cassette according to the embodiment.
Figure 2B:
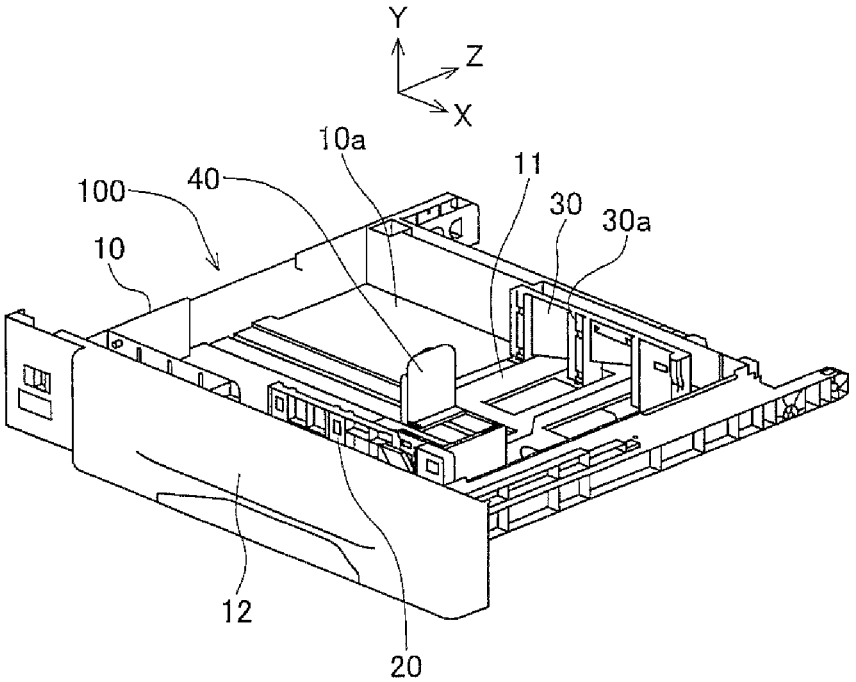

Hereinafter, referring to FIG. 2 through FIG. 8, the structure of the paper cassette 100 according to the embodiment is described. FIG. 2A and FIG. 2B are a plan view and a perspective view showing the structure of the paper cassette 100.

As shown in FIGS. 2A, 2B, the paper cassette 100 is formed with a cassette body 10 as a sheet containing unit, a front side paper guide (hereinafter referred to as "front guide") 20, a rear side paper guide (hereinafter referred to as "rear guide") 30, and a tail side paper guide (hereinafter referred to as "tail guide") 40.

The cassette body 10 is a container for containing the paper 101. In the cassette body 10, the paper loading plate 11 is installed for stacking the paper 101. More specifically, the cassette body 10 has a bottom portion 10*a* in a rectangular plate shape extending in the X-direction and the Z-direction, and the paper loading plate 11 is attached movably on the bottom portion 10*a*. A cassette cover 12 is detachably attached on a near side (−Z-direction side) of the cassette body 10. The cassette cover 12 is formed with a grip to be gripped when the paper cassette 100 is attached and detached.

The front guide 20, the rear guide 30, and the tail guide 40 are guide members guiding the paper 101 contained in the cassette body 10, and are mounted in the cassette body 10. The front guide 20, the rear guide 30, and the tail guide 40 are attached to the bottom portion 10*a* in a movable manner in a prescribed direction.

The front guide 20 and the rear guide 30 are mounted movably in a width direction (Z-direction) of the paper 101, and guide ends in the width direction of the paper 101. The front guide 20 and the rear guide 30 are disposed facing each other in the Z-direction. The front guide 20 is disposed on the −Z-direction side and has a regulation surface 20*a* regulating the position of the end of the paper 101 on the −Z-direction side. The rear guide 30 is disposed on the +Z-direction side and has a regulation surface 30*a* regulating the position of the end of the paper 101 on the +Z-direction side. The tail guide 40 is mounted movably in a length direction (X-direction) of the paper 101, and regulates the position of the rear end (end on the −X-direction side) in the conveyance direction of the paper 101.

The front guide 20, the rear guide 30, and the tail guide 40 are structured to be secured at prescribed positions corresponding to the sizes of the paper 101 to be contained, respectively. As such prescribed positions, used are positions corresponding to the paper 101 in standard sizes such as A3 and A4, as well as letter and legal, and positions corresponding to the paper 101 in non-standard sizes as sizes other than the standard sizes. A user can contain, in a way to be fed, the paper 101 in the standard sizes and the non-standard sizes in the paper cassette 101, by setting the positions of the front guide 20, the rear guide 30, and the tail guide 40 to the positions corresponding to the contained paper 101.

With the front guide 20 and the rear guide 30, rack gears 20*b*, 30*b* extending in the Z-direction respectively are formed, and pinion gears, not shown, in mesh with the rack gears 20*b*, 30*b* are provided at the bottom portion 10*a* of the cassette body 10. According to move of one of the front guide 20 and the rear guide 30, the other of the guides moves in the same moving amount in the direction opposite to the one of the guides by action of the rack gears 20*b*, 30*b* and the pinion gears. With this operation, the center position in the Z-direction between the regulation surface 20*a* of the front guide 20 and the regulation surface 30*a* of the rear guide 30 is maintained at a constant point.

Figure 3A:
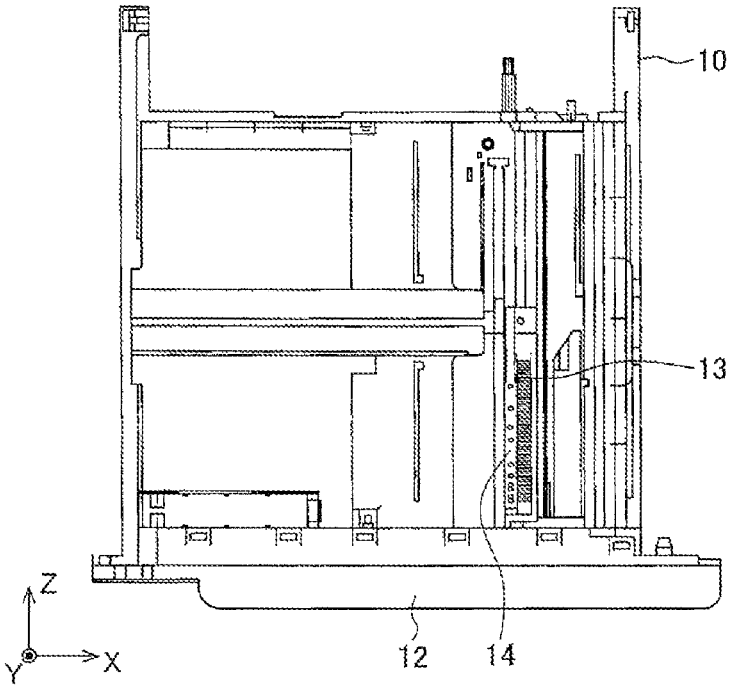
FIGS. 3A, 3B are a plan view and an enlarged part view, respectively, showing a cassette body according to the embodiment.
Figure 3B:
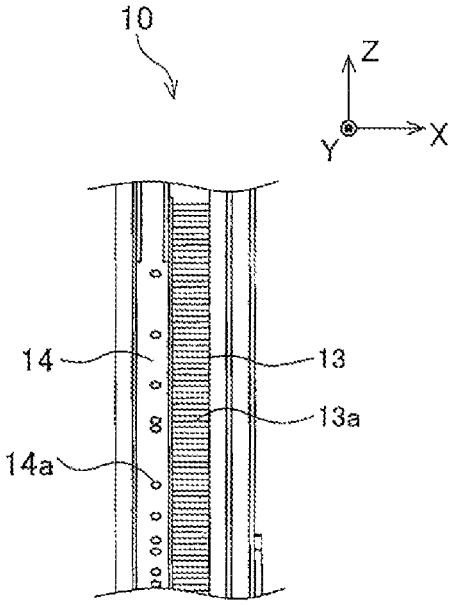

FIGS. 3A, 3B are a plan view and an enlarged part view, respectively, showing a structure of the cassette body 10. As shown in FIGS. 3A, 3B, a first engaged portion 13 and a second engaged portion 14 are formed at the cassette body 10 to hold or secure the front guide 20 to the prescribed positions.

The first engaged portion 13 holds the front guide 20 at plural holding positions in the Z-direction by engaging a first engaging portion 22 formed on a side of the front guide 20. In this embodiment, the first engaged portion 13 has plural engagement pawls 13*a* as plural engagement projections arranged with equal intervals in the Z-direction. The plural engagement pawls 13*a* form a group of engagement pawls for non-standard sizes for holing the front guide 20 when the paper 101 in a non-standard size is contained. The first engaged portion 13 extends long in the Z-direction so as to be able to correspond the paper in various sizes.

The second engaged portion 14 holds the front guide 20 at prescribed positions in the Z-direction by engaging the second engaging portion 24 described below formed on a side of the front guide 20. In this embodiment, the second engaged portion 14 has plural engagement holes or engagement grooves 14*a* arranged in the Z-direction. The plural engagement holes 14*a* form a group of engagement holes for standard sizes for holing the front guide 20 when the paper 101 in a standard size is contained. The plural engagement holes 14*a* are arranged at the plural positions corresponding to the paper 101 of plural kinds such as, e.g., A3 and A4, as well as letter and legal. It is to be noted that in this embodiment the engagement holes 14*a* are provided in a plural number, but a sole the engagement hole 14*a* may be acceptable.

Figure 4A:
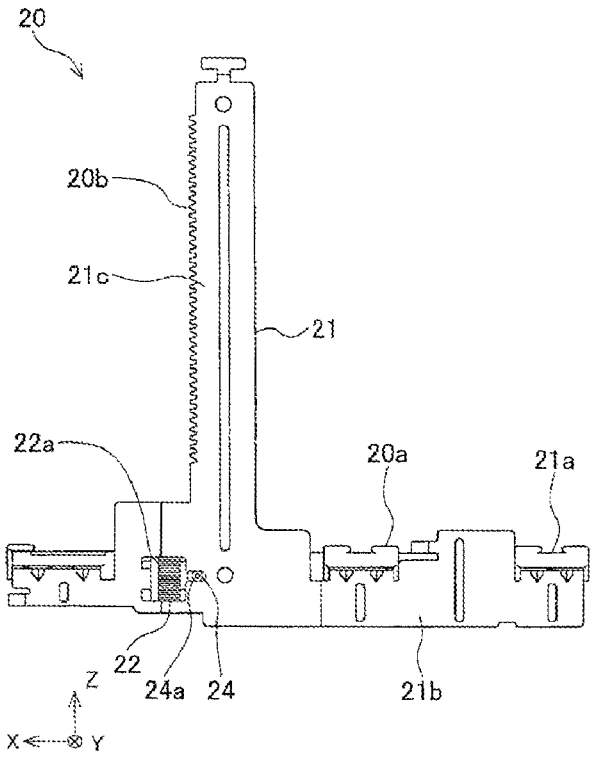
FIGS. 4A, 4B are a back view and an exploded perspective view, respectively, showing a front guide according to the embodiment.
Figure 4B:
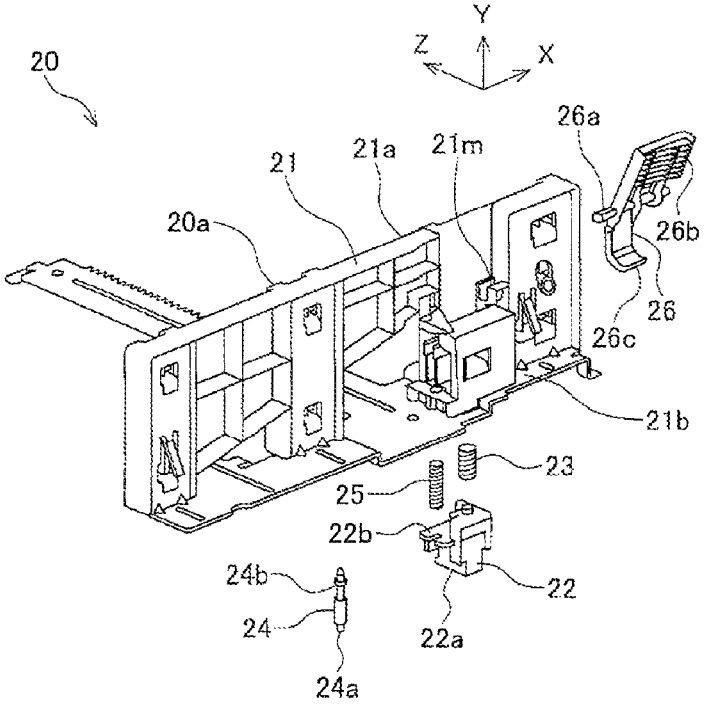

FIGS. 4A, 4B are a back view and an exploded perspective view, respectively, showing a structure of the front guide 20. As shown in FIGS. 4A, 4B, the front guide 20 has a guide body 21 as a regulation member, the first engaging portion 22, a first urging member 23, the second engaging portion 24, a second urging member 25, and a lever 26.

The guide body 21 is formed movably in a prescribed moving direction (herein the Z-direction) with respect to the cassette body 10, and is a member regulating the position of the paper 101 contained in the cassette body 10. The guide body 21 has a regulation portion 21*a* having a regulation surface 20*a* regulating the end of the paper 101, a support portion 21*b* supporting the regulation portion 21*a* in a state the regulation portion 21*a* is made upright on the cassette body 10, and a rack portion 21*c* having the rack gear 20*b*.

The first engaging portion 22 is formed at the guide body 21 as to engage the first engaged portion 13 on a side of the cassette body 10. In this embodiment, the first engaging portion 22 has plural engagement grooves 22*a* engaging the plural engagement pawls 13*a* of the first engaged portion 13. The plural engagement grooves 22*a* are provided at an end on a side of the −Y-direction (or lower end) of the first engaging portion 22. The plural engagement grooves 22*a* form a group of engagement holes for non-standard sizes for holing the front guide 20 when the paper 101 in a non-standard size is contained. The first engaging portion 22 engages a part in the Z-direction of the first engaged portion 13, and is shorter than the first engaged portion 13. The first engaging portion 22 is formed movably in a direction coming close to and going away from the first engaged portion 13. More specifically, the first engaging portion 22 is attached at a position facing the first engaged portion 13 in a way movable in the Y-direction with respect to the guide body 21.

The first urging member 23 urges the first engaging portion 22 toward the first engaged portion 13. More specifically, the first urging member 23 is disposed between the guide body 21 and the first engaging portion 22, and urges the first engaging portion 22 in the −Y-direction. The first urging member 23 is, e.g., a coil spring.

The second engaging portion 24 is formed at the guide body 21 as to engage the second engaged portion 14 on a side of the cassette body 10. In this embodiment, the second engaging portion 24 has an engagement pin 24*a* serving as an engagement projection engaging any of the plural engagement holes 14*a* of the second engaged portion 14. The engagement pin 24*a* is provided at an end in the −Y-direction (lower end) of the second engaging portion 24. The engagement pin 24*a* is an engagement member for standard sizes for holding the front guide 20 when the paper 101 of the standard sizes is contained. The second engaging portion 24 is formed movably in a direction coming close to and going away from the second engaged portion 14 More specifically, the second engaging portion 24 is attached at a position facing the second engaged portion 14 in a way movable in the Y-direction with respect to the guide body 21.

The second urging member 25 urges the second engaging portion 24 toward the second engaged portion 14. More specifically, the second urging member 25 is disposed between the guide body 21 and the second engaging portion 24, and urges the second engaging portion 24 in the −Y-direction. The second urging member 25 is, e.g., a coil spring.

The lever 26 is a manipulation member for releasing holding of the front guide 20. The lever 26 is formed in a pivotally moving manner or a rockable manner with respect to the guide body 21, and exerts external force to the first engaging portion 22 by moving pivotally or rocking upon receiving manipulation force. With this external force, the first engaging unit 22 moves in the +Y-direction, and in association with this move, the second engaging portion 24 moves in the +Y-direction, thereby disengaging the first engaging portion 22 from the second engaging portion 24.

In this embodiment, from a viewpoint to reduce the load when releasing the holding of the front guide 20, the first engaging portion 22 and the first engaged portion 13 are structured as follows.

Figure 5:
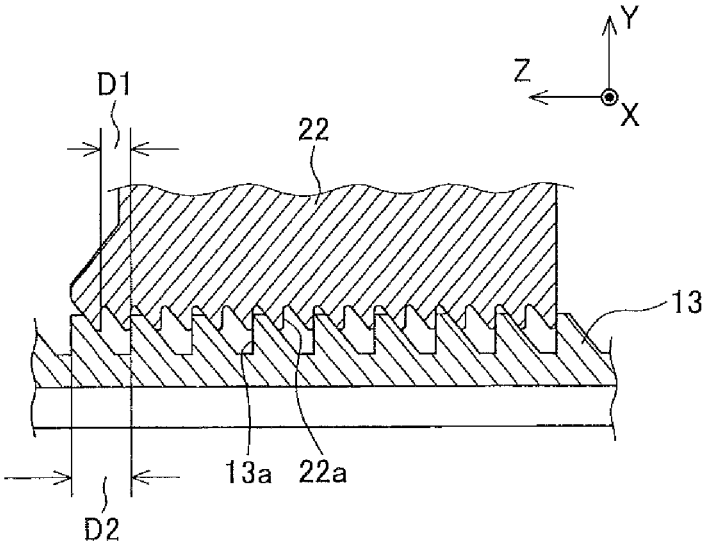
FIG. 5 is a cross section showing a state engaging a first engaging portion with a first engaged portion according to the embodiment.

FIG. 5 is a cross section showing a state engaging the first engaging portion 22 with the first engaged portion 13. As shown in FIG. 5, the plural engagement grooves 22*a* are arranged with first intervals D1 in the Z-direction; the plural engagement pawls 13*a* are arranged with second intervals D2 in the Z-direction; the second interval D2 is twice of the first interval D1. That is, the installation interval D2 or pitch of the plural engagement pawls 13*a* is two times of the installation interval D1 or pitch of the plural engagement grooves 22*a*. In this structure, the interval of the plural holding positions at which the front guide 20 (or the guide body 21) is held, or namely the interval of the positions that the front guide 20 can be held, is equal to the first interval D1. The first interval D1 can be set desirably and is, e.g., 1 mm, approximately.

Figure 6A:
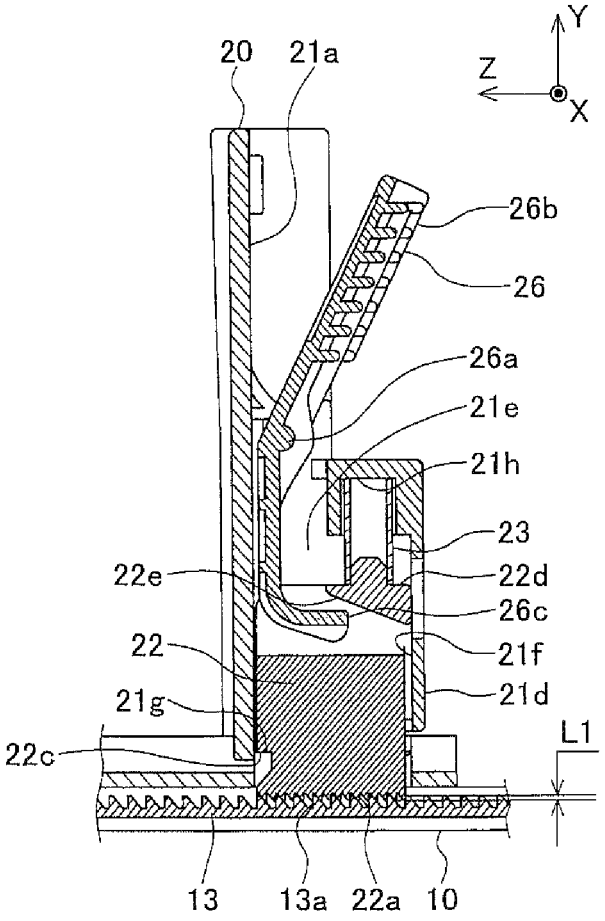
FIGS. 6A, 6B are cross sections showing a state that both of the first engaging portion and a second engaging portion are engaging according to the embodiment.
Figure 6B:
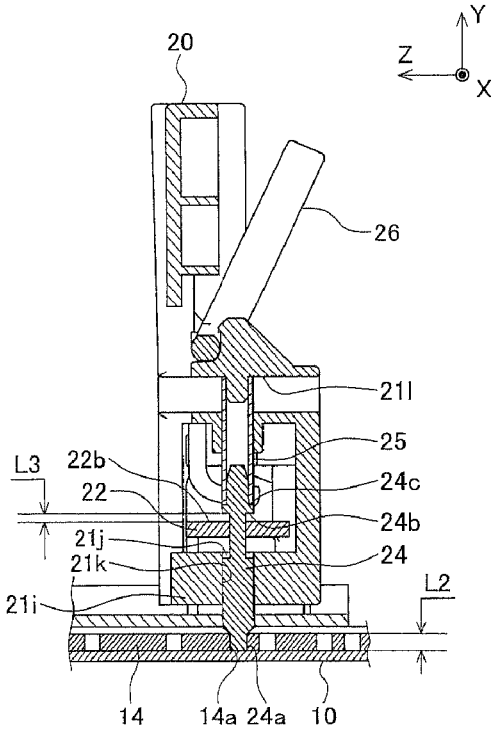
Figure 7A:
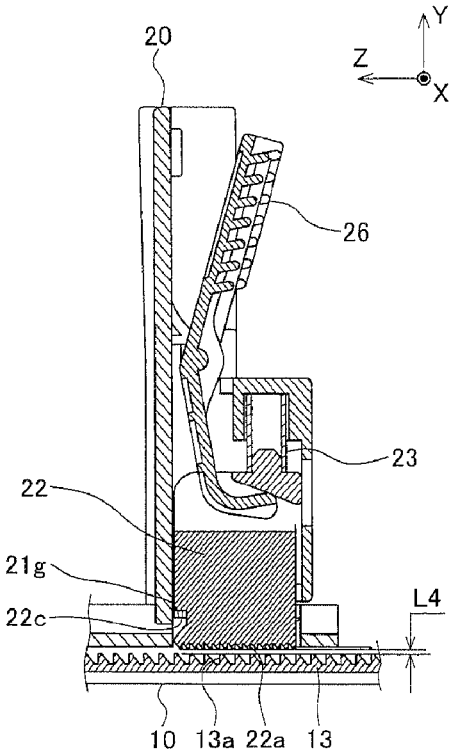
FIGS. 7A, 7B are cross sections showing a state that only the second engaging portion between the first and second engaging portions is engaging according to the embodiment.
Figure 7B:
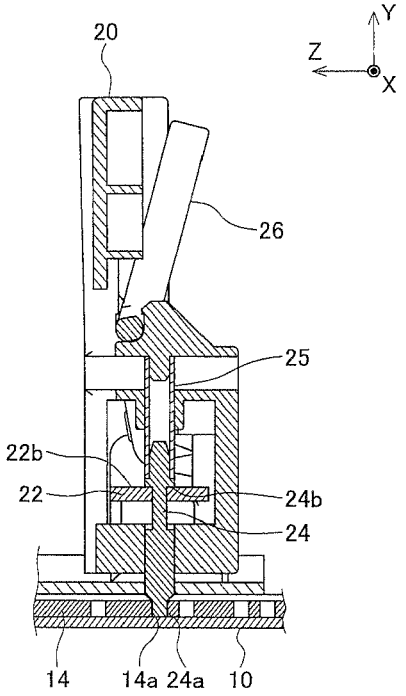
Figure 8A:
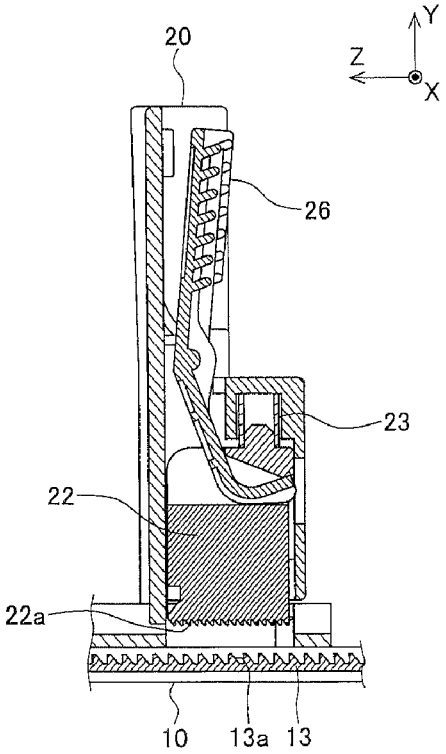
FIGS. 8A, 8B are cross sections showing a state that both of the first engaging portion and the second engaging portion are not engaging according to the embodiment.
Figure 8B:
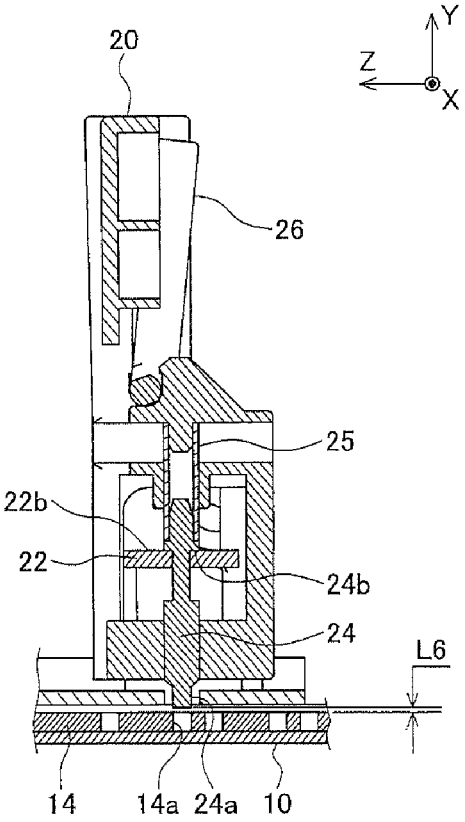

In this embodiment, the first engaging portion 22 and the second engaging portion 24 are structured as follows. FIGS. 6A, 6B are cross sections showing a state that both of the first engaging portion 22 and the second engaging portion 24 are engaging. FIGS. 7A, 7B are cross sections showing a state that only the second engaging portion 22 between the first and second engaging portions 22, 24 is engaging. FIGS. 8A, 8B are cross sections showing a state that both of the first engaging portion 22 and the second engaging portion 24 are not engaging. FIGS. 6A, 7A, 8A are cross sections of the cassette body 10 and the front guide 20 in cutting along a Y-Z plane at a center position in the X-direction of the first engaging portion 22 when viewed from a side of the −X-direction. FIGS. 6B, 7B, 8B are cross sections of the cassette body 10 and the front guide 20 in cutting along the Y-Z plane at a center position in the X-direction of the second engaging portion 24 when viewed from the side of the −X-direction.

The first engaging portion 22 and the second engaging portion 24 are structured so that the first engaging portion 22 moves in a direction separating from the second engaging portion 24 upon reception of external force from the lever 26 to disengage the first engaging portion 22 and the first engaged portion 13 from each other and then the second engaging portion 24 moves in a direction separating from the second engaged portion 14 upon reception of force from move of the first engaging portion 22 to disengage the second engaging portion 24 and the second engaged portion 14 from each other.

Specifically, the first engaging portion 22 has a contact surface 22*b* for applying force to the second engaging portion 24, and the second engaging portion 24 has a contact surface 24*b* for receiving force from the first engaging portion 22. As shown in FIGS. 6A, 6B, where both of the first engaging portion 22 and the second engaging portion 24 are engaging, the two contact surfaces 22*b*, 24*b* are separated from each other. When the first engaging portion 22 moves in the +Y-direction (up direction) according to external force, the contact surface 22*b* of the first engaging portion 22 contacts the contact surface 24*b* of the second engaging portion 24 as shown in FIGS. 7A, 7B after the first engaging portion 22 is disengaged, thereby providing the force in the +Y-direction. With this force, the second engaging portion 24 moves in +Y-direction, and as shown in FIGS. 8A, 8B, the second engaging portion 24 is disengaged.

Hereinafter, a mechanism holding the front guide 20 is described more specifically. Referring mainly to FIG. 6A, a structure relating to the first engaging portion 22 and the first engaged portion 13 is described.

In FIG. 6A, the plural engagement grooves 22 of the first engaging portion 22 and the plural engagement pawls 13*a* of the first engaged portion 13 engage each other. The engagement pawls 13*a* at that time enter into the engagement grooves 22*a* by a prescribed length L1 in the Y-direction.

The engagement pawl 13*a* has a tapered shape becoming narrower as coming closer to a tip thereof, and the engagement groove 22*a* has a tapered shape becoming wider as coming closer to a tip thereof. With those structures, the first engaging portion 22 can move more freely when engaging and disengaging, so that the first engaging portion 22 can easily engage and disengage the first engaged portion 13.

The first engaged portion 13 is made of a resin, and is formed together with the cassette body 10. The first engaged portion 13, however, can be made of other materials, and can be attached to the cassette body 10. The first engaging portion 22 is formed of a resin having a higher strength than the first engaged portion 13, but can be formed from other materials.

The first engaging portion 22 is guided upon contained in a guide portion 21*d* formed at the guide body 21. The guide portion 21*d* includes an inner space 21*e* for containing the first engaging portion 22, and an inner wall 21*f* defining the inner space 21*e*. The inner wall 21*f* regulates the position of the first engaging portion 22 in the X-direction and the Z-direction, thereby guiding the move of the first engaging portion 22 in the Y-direction. The guide portion 21*d* has a stopper surface 21*g* regulating the move of the first engaging portion 22 in the −Y-direction. The guide portion 21*d* stops the move of the first engaging portion 22 in the −Y-direction further more by contacting a stopper surface 22*c* formed at the first engaging portion 22. A gap is formed between the inner wall 21*f* and the first engaging portion 22, thereby allowing the move in the X-direction and the Z-direction and an inclination in the Y-direction of the first engaging portion 22 in a prescribed range in the inner space 21*e*. That is, the first engaging portion 22 is not contained tightly in the guide portion 21*d* but contained in a swingable manner with respect to the guide body 21. With this structure, when engaged and disengaged, the first engaging portion 22 can move to position and direction easily movable, so that the first engaging portion 22 can be readily engaged and disengaged.

An urged surface 22*d* is formed at an end of the first engaging portion 22 on the +Y-direction for receiving the urging force from the first urging member 23. A support surface 21*h* is formed on the guide body 21 on a side in the +Y-direction of the first engaging portion 22 for supporting the first urging member 23. The first urging member 23 is disposed between the urged surface 22*d* and the support surface 21*h*.

The first engaging portion 22 has a lever contact surface 22*e* contacting the lever 26 and receiving external force from the lever 26, and a contact surface 22*b* (see, FIG. 6A) for providing pushing force to the second engaging portion 24.

Referring to FIG. 6B, a structure relating to the second engaging portion 24 and the second engaged portion 14 is described next. In FIG. 6B, the engagement pin 24*a* of the second engaging portion 24 engages one of the plural engagement holes 14*a* of the second engaged portion 14. The engagement pin 24*a* enters into the engagement hole 14*a* by a prescribed length L2 in the Y-direction. The engagement pin 24*a* is inserted deeply into the engagement hole 14*a* so that the front guide 20 is adequately secured where the paper in the standard size is contained, and the length L2 is longer than the length L1.

Each of the engagement pin 24*a* and the engagement holes 14*a* extends in a direction parallel to the Y-direction, and has no taper. With this structure, the second engaging portion 24 is less freely movable in comparison with the first engaging portion 22 when engaged and disengaged, so that the second engaging portion 24 can be engaged and disengaged in a harder manner.

The second engaged portion 14 is made of a metal, and is attached to the cassette body 10. The second engaged portion 14, however, can be made of other materials, and can be formed in a united body with the cassette body 10. The second engaging portion 24 is also formed of a metal, but can be formed from other materials.

The second engaging portion 24 is guided upon contained in a guide portion 21*i* formed at the guide body 21. The guide portion 21*i* includes an inner space 21*j* for containing the second engaging portion 24, and an inner wall 21*k* defining the inner space 21*j*. The inner wall 21*k* regulates the position of the second engaging portion 24 in the X-direction and the Z-direction, thereby guiding the move of the second engaging portion 24 in the Y-direction. There provides a tiny gap between the inner wall 21*k* and the second engaging portion 24, but this gap is smaller in comparison with the gap between the inner wall 21*f* and the first engaging portion 22, and the second engaging portion 24 is contained tightly in the guide portion 21*i*. With this structure, where the second engaging portion 24 engages the second engaged portion 14, the guide body 21 is firmly secured at the position.

An urged surface 24*c* is formed at an end of the second engaging portion 24 on the +Y-direction for receiving the urging force from the second urging member 25. A support surface 21*l* is formed on the guide body 21 on a side in the +Y-direction of the second engaging portion 24 for supporting the second urging member 25. The second urging member 25 is disposed between the urged surface 24*c* and the support surface 21*l*. The second engaging portion 24 further has a contact surface 24*b* for receiving pushing force from the first engaging portion 22.

Next, an arrangement of the contact surface 22*b* of the first engaging portion 22 and the contact surface 24*b* of the second engaging portion 24 is described. As shown in FIGS. 6A, 6B, where both of the first engaging portion 22 and the second engaging portion 24 are engaging, the contact surface 24*b* is disposed at a position away from the contact surface 22*b* by a prescribed distance L3 in the +Y direction. The distance L3 is longer by a prescribed distance L4 than the length L1, or namely, L3=L1+L4.

Accordingly, where the first engaging portion 22 moves in the +Y-direction by the distance L1 from the state shown in FIGS. 6A, 6B, the first engaging portion 22 disengages the first engaged portion 13. Where the first engaging portion 22 further moves in the +Y-direction by the distance L4, the contact surface 22*b* comes in contact with the contact surface 24*b* as in the state shown in FIGS. 7A, 7B. The second engaging portion 24 at that time remains as engaging the second engaged portion 14. The first engaging portion 22 is structured as movable in the +Y-direction by a prescribed distance L5 from the position that the contact surface 22*b* contacts the contact surface 24*b*. The distance L5 is longer than the length L2 by a prescribed distance L6, or namely L5=L2+L6.

Accordingly, where the first engaging portion 22 moves in the +Y-direction by the distance L2 from the state shown in FIGS. 7A, 7B, the second engaging portion 24 also moves in the +Y-direction by the distance L2 in association with that move, and the second engaging portion 24 disengages the second engaged portion 14. If the first engaging portion 22 further moves in the +Y-direction by the distance L6 from this position, the second engaging portion 24 also moves in the +Y-direction by the distance L6 in association with that move as in the state shown in FIGS. 8A, 8B.

Next, the lever 26 is described in reference to FIG. 4 and FIG. 6A. The lever 26 is a lever member being formed as pivotally movable around a pivotal axis 26*a* as a center serving as a fulcrum or a support with respect to the guide body 21, having a manipulation portion 26*b* as a power application point receiving manipulation force on one side of the pivotal axis 26*a*, and having a movable portion 26*c* as a point of action actuating external force o the first engaging portion 22 on the other side of the pivotal axis 26*a*. More specifically, the pivotal axis 26*a* extends in the X-direction, and its ends are supported by bearings 21*m* formed on a side of the guide body 21. The manipulation portion 26*b* extends from the pivotal axis 26*a* toward a side in the Y-direction. Where no manipulation force applies, the manipulation portion 26*b* is inclined on a side in the −Z-direction with respect to the Y-direction, and is apart from the regulation portion 21*a* of the guide body 21 by a prescribed angle. The movable portion 26*c* extends toward a side in the −Y-direction from the pivotal axis 26*a*, and its tip is bent in the −Z-direction toward the lever contact surface 22*e* of the first engaging portion 22.

The lever 26 is structured for receiving force in a direction parallel to the move direction of the guide body 21 (the Z-direction) as the manipulation force. More specifically, the lever 26 is structured as to transmit the manipulation force in the +Z-direction exerted to the manipulation portion 26*b* to the first engaging portion 22 upon converting into force in the +Y-direction. More specifically, where the manipulation force in a direction toward the regulation portion 21*a* is exerted to the manipulation portion 26*b*, the lever 26 moves pivotally around the pivotal axis 26*a* as a fulcrum, and is disposed as to actuate external force from the contact of the movable portion 26*c* to the lever contact surface 22*e*.

Thus, the lever 26, the first engaging portion 22, and the second engaging portion 24 are structured so that, when the lever 26 moves pivotally, the first engaging portion 22 performs a linear motion according to the pivotal motion of the lever 26, and the second engaging portion 24 performs a liner motion according to the liner motion of the first engaging portion 22.

Hereinafter, operation of the paper cassette 100 is described along with user's manipulation. When the paper 101 is contained in the paper cassette 100, the user makes the front guide 20 slide in the Z-direction according to the size of the paper 101 after locking of the front guide 20 is released by manipulating the lever 26, and locks the front guide 20 by releasing the hand from the lever 26.

When the lock of the front guide 20 is released, the paper cassette 100 operates as follows. Initially, it is assumed herein that both of the first engaging portion 22 and the second engaging portion 24 are engaged as shown in FIGS. 6A, 6B.

In the state shown in FIGS. 6A, 6B, the manipulation force is exerted to the lever 26 upon the user's manipulation of the lever 26, the lever 26 moves pivotally and contacts the first engaging portion 22 to exert the external force to the first engaging portion 22. With this operation, the first engaging portion 22 moves in the +Y-direction according to pivotal move of the lever 26, thereby releasing engagement between the first engaging portion 22 and the first engaged portion 13. Where the first engaging portion 22 further moves in the +Y-direction as the user's manipulation of the lever 26 continues, the contact surface 22*b* contacts the contact surface 24*b* as shown in FIGS. 7A, 7B, and the second engaging portion 24 moves in the +Y-direction according to the move of the first engaging portion 22, thereby releasing engagement between the second engaging portion 24 and the second engaged portion 14 as shown in FIGS. 8A, 8B. With this operation, the front guide 20 is unlocked, and the front guide 20 is made slidable.

In a case where only the first engaging portion 22 between the first engaging portion 22 and the second engaging portion 24 is engaging initially, the first engaging portion 22 moves in the +Y-direction according to the manipulation of the lever 26, and the front guide 20 is unlocked at a timing that the first engaging portion 22 disengages the first engaged portion 13, thereby making the front guide 20 slidable.

Where the front guide 20 is locked, the paper cassette 100 operates as follows. Herein, a case that the paper 101 in the standard size is contained is described.

In the state shown in FIGS. 8A, 8B, the manipulation force to the lever 26 is nullified by the user's release of the hand from the lever 26, the first engaging portion 22 and the second engaging portion 24 move in the −Y-direction according to urging force of the first urging member 23 and the second urging member 25, and engage the first engaged portion 13 and the second engaged portion 14, respectively. With this operation, the front guide 20 is locked at the position corresponding to the standard size. In this case, the first engaging portion 22 may be not engaged with first engaged portion 13.

In a case where the paper 101 in the non-standard size is contained, the front guide 20 is locked at the position corresponding to the non-standard size by engaging the first engaging portion 22 with the first engaged portion 13. At that time, the engagement pin 24*a* of the second engaging portion 24 contacts a portion other than the engagement hole 14*a* of the second engaged portion 14, and does not engage the engagement hole 14*a*.

The interval of the position that the front guide 20 can be locked is the same as the installation interval or the first interval D1 of the engagement grooves 22*a*, so that the user can change the position that the front guide 20 is locked, by each of the interval D1. That is, an adjustment pitch of the locking position of the front guide 20 is D1.

Figure 9:
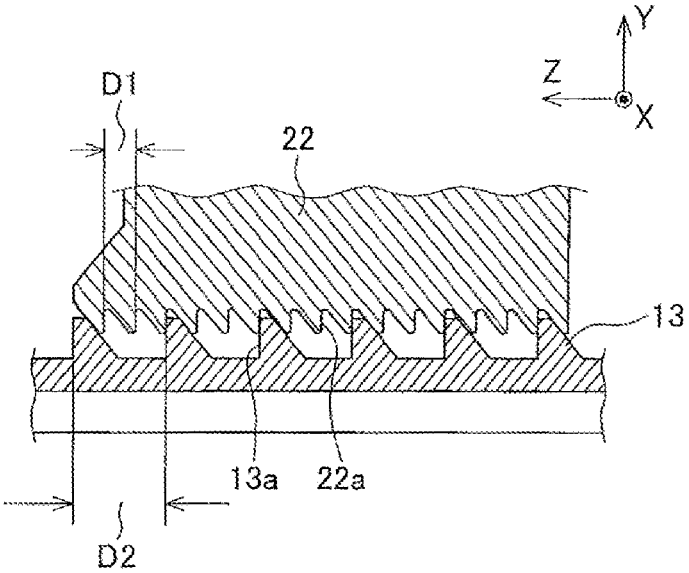
FIG. 9 is a cross section showing a modification of the first engaging portion and the first engaged portion.

It is to be noted that according to the description above, exemplified is a case that the second interval (installation interval of the engagement pawl 13*a*) D2 is twice of the first interval (installation interval of the engagement grooves 22*a*) D1, but the second interval D2 can be any of the integer multiple equal to two or more of the first interval D1. That is, the second interval D2 can be N multiple (N=2, 3, 4, . . . ) of the first interval D1. For example, as shown in FIG. 9, the second interval D2 can be triple of the first interval D1.

Figure 10:
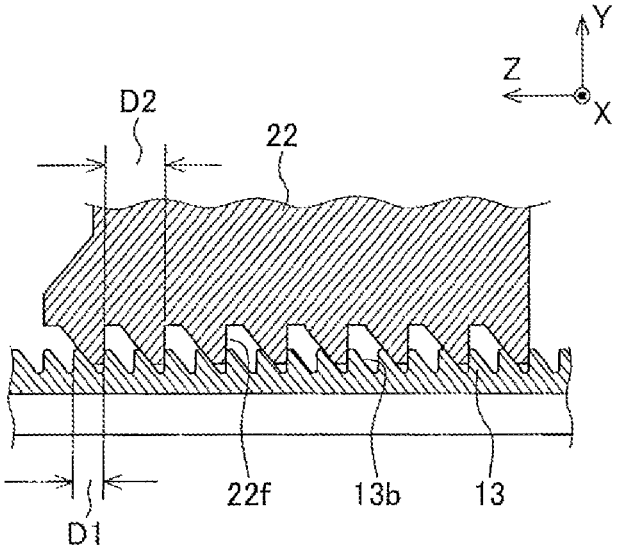
FIG. 10 is a cross section showing another modification of first engaging portion and the first engaged portion.

In the above description, exemplified is the structure such that the first engaged portion 13 has the plural engagement pawls 13*a* whereas the first engaging portion 22 has the plural engagement grooves 22*a*, but the opposite combination can be allowed. That is, as shown in FIG. 10, the first engaging portion 22 may have the plural engagement pawls 22*f*, and the first engaged portion 13 may have the plural engagement grooves 13*b*. In FIG. 10, the installation interval D2 of the engagement pawl 22*f* is set to twice of the installation interval D1 of the engagement groove 13*b*.

In accordance with the embodiment described above, the following first to fifth advantages are obtainable.

As the first advantage, the installation interval D2 of the engagement pawls 13*a* is an integer multiple of two or more of the installation interval D1 of the engagement grooves 22*a*. According to this structure, the contact area between the engagement pawl and the engagement groove can be reduced while maintaining the interval of the holding position in comparison with the structure that the installation interval of the engagement pawls and the installation interval of the engagement grooves are equal to each other, or namely the structure that the engagement pawl and the engagement groove are corresponding to each other one by one.

The engagement pawl 13*a* can be made larger without widening the interval of the holding position, so that the strength of the engagement pawls 13*a* can be made stronger. With this structure, for example, the sheet containing device can prevent the engagement pawls 13*a* from broken down. By forming the engagement pawls 13*a* larger, the force holding the position of the guide body 21 can be made stronger. More specifically, the engagement pawl 13*a* can have a higher rigidity by forming the engagement pawl 13*a* larger, thereby preventing the engagement pawl 13*a* by disengaging due to deformation of the engagement pawl 13*a* caused by external force. With this structure, the paper cassette 100 can be provided in which the guide body 21 does not move or the engagement pawl 13*a* is not broken even where large external force is exerted in a situation such that, e.g., the paper cassette 100 is attached to the apparatus body 2. It is to be noted that in a case where the first advantage is to be obtained, the second engaging portion 24 and the second engaged portion 14 may be omitted.

As the second advantage, the first engaged portion 13 has the plural engagement pawls 13*a*, and the first engaging portion 22 has the plural engagement grooves 22*a*. According to this structure, the costs of the paper cassette 100 can be suppressed in comparison with the opposite situation. More specifically, the first engaged portion 13 formed on the side of the cassette body 10 is a member extending in the Z-direction, whereas the first engaging portion 22 formed on the side of front guide 20 is a shirt member engaging a part of the first engaged portion 13, so that the first engaged portion 13 is larger than the first engaging portion 22. In this situation, where the engagement pawls are formed on the side of the first engaged portion 13, an inexpensive material having a low rigidity may be used as a material for the first engaged portion 13 as a larger member. Particularly, where the first engaged portion 13 is molded as a united body with the cassette body 10, the strength of the first engaged portion 13 is ensured by forming engagement pawls on the side of the first engaged portion 13 even where an inexpensive material having a low rigidity is used as the material of the cassette body 10. Fabrication costs may be suppressed by forming the engagement grooves requiring a precise fabrication with narrower pitches on the side of the first engaging portion 22 as a smaller member.

As the third advantage, the first engaging portion 22 and the second engaging portion 24 are structured so as to disengage the second engaging portion 24 from the second engaged portion 14 after the first engaging portion 22 disengages the first engaged portion 13. With this structure, the load at a time of disengaging can be reduced in comparison with the structure in which the first engaging portion 22 and the second engaging portion 24 are disengaged at the same time. According to this structure, the load applied to the lever 26 when releasing the holding of the guide body 21 can be reduced, and therefore, the lever 26 can be prevented from broken down.

For example, with a structure in which two engaging portions are disengaged at the same time by the lever, the load to disengage the two engaging portions applies to the lever at the same time. To the contrary, the structure in which two engaging portions are disengaged subsequently one by one likewise that in this embodiment can prevent the load to disengage the two engaging portions from applying to the lever at the same time.

Furthermore, with a structure in which two engaging portions are disengaged at the same time by the lever, the disengaging operation for one engaging portion may interfere with the disengaging operation for the other, and occurrences of the load due to interference can be avoided or suppressed.

In a case where the third advantage is obtained, the installation interval D2 of the engagement pawls 13 may not be an integer multiple of two or more of the installation interval D1 of the engagement grooves 22*a* and may be the same as the installation interval D1. The first engaging portion 22, the first engaged portion 13, the second engaging portion 24, and the second engaged portion 14 are not limited to those described above, and can be modified in an appropriate manner.

As the fourth advantage, the move of the first engaging portion 22 and the move of the second engaging portion 24 are liner motions, respectively. That is, the first engaging portion 22 performs the liner motion according to external force, and the second engaging portion 24 performs the liner motion according to the liner motion of the first engaging portion 22. With this structure, force from the liner motion can move the second engaging portion 24, thereby reducing the load when the second engaging portion 24 is disengaged. For example, where the structure is formed in which the second engaging portion 24 moves in the Y-direction according to force from the pivotal motion of such as, e.g., the pivotal lever, not only force in the Y-direction but also force in the X-direction or the Z-direction are exerted to the second engaging portion 24. With this structure, the frictional force between the second engaging portion 24 and the second engaged portion 14 is made larger, thereby increasing the load when disengaging. To the contrary, according to this embodiment, force only in substantially the Y-direction can be exerted to the second engaging portion 24 from the liner motion in the Y-direction of the first engaging portion 22, so that the frictional force between the second engaging portion 24 and the second engaged portion 14 can be suppressed. Particularly, remarkable effects are obtainable where the second engaging portion 24 has a little freedom on the moving direction when disengaged, as well as where the second engaging portion 24 firmly engages the second engaged portion 14.

As the fifth advantage, the paper cassette 100 has the lever 26 providing external force to the first engaging portion 22 when moved pivotally upon receiving the manipulation force. With this structure, a good manipulation ability is obtainable. More specifically, by structuring the lever 26 as a lever member, the manipulation force can be reduced for disengagements. The manipulation direction when disengaging and the moving direction of the guide body 21 can coincide with each other by forming the lever 26 as to receive the force in a direction parallel to the moving direction of the guide body 21 as the manipulation force. For example, the user can disengage the front guide 20 and make the front guide 20 slide by exerting the force in the Z-direction.

It is to be noted that in this specification, the meaning of the term "parallel" is not limited to a restrictive sense of "parallel" but includes the meaning of "substantially parallel." This invention is not limited to above embodiments, and can be used with various features as far as not deviated from the scope of the invention.

For example, the holding mechanism described above is applicable to, e.g., the tail guide 40, other than the front guide 20. The lever 26 can be omitted, and for example, the first engaging portion 22 can be formed as receiving external force directly from the user. In the above embodiment, exemplified is the structure that the second engaging portion 24 moves according to the move of the first engaging portion 22, it can be formed so that the first engaging portion 22 moves according to the move of the second engaging portion 24. In addition, exemplified in the above embodiment is the structure that the front guide 20 and the rear guide 30 move together, but the rear guide 30 may be secured.

This invention is applicable to image forming apparatuses of a method other than described above, and is applicable to, e.g., an image forming apparatus transferring toner images from process units directly to printing media, a monochrome image forming apparatus using a single process unit. This invention is also applicable to image forming apparatuses of a method other than the electrophotographic method, such as, e.g., an inkjet method. This invention is applicable to image forming apparatuses other than printers, such as, e.g., photocopiers and facsimile machines. The sheet containing device according to the invention may be applicable to an automatic original document reader or scanner, and the original documents to be read can be contained as sheets.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet containing device comprising:

a sheet containing unit for containing a sheet;

a regulation member arranged movably in a prescribed moving direction with respect to the sheet containing unit for regulating a position of the sheet contained in the sheet containing unit in the moving direction;

a first engaging portion provided at the regulation member; and a first engaged portion provided at the sheet containing unit for holding the regulation member at plural holding positions in the moving direction by engaging the first engaging portion, wherein one of the first engaging portion and the first engaged portion has a plurality of engagement grooves arranged with first intervals in the moving direction, wherein the other of the first engaging portion and the first engaged portion has a plurality of engagement projections arranged with second intervals in the moving direction, the engagement projections engaging the plural engagement grooves, and wherein an interval of the plural holding positions is equal to the first interval whereas the second interval is an integral multiplication equal to or greater than two of the first interval.

2. The sheet containing device according to claim 1, wherein the first engaged portion has the plurality of the engagement projections, whereas the first engaging portion has the plurality of the engagement grooves.

3. The sheet containing device according to claim 1, wherein the plurality of the engagement grooves and the plurality of the engagement projections are arranged in line, respectively, in the moving direction of the regulation member.

4. The sheet containing device according to claim 3, further comprising:

a second engaging portion provided at the regulation member; and a second engaged portion provided at the sheet containing unit for holding the regulation member at plural holding positions in the moving direction by engaging the second engaging portion.

5. The sheet containing device according to claim 4, wherein the second engaged portion has one or more engagement holes at respective positions corresponding to standard sizes of one or more kinds, and wherein the second engaging portion has engagement projection or projections engaging one or more of the engagement holes.

6. The sheet containing device according to claim 4, wherein the first and second engaging portions are structured so that after the first engaging portion disengages from the first engaged portion according to movement of the first engaging portion in a direction apart from the first engaged portion upon reception of external force, the second engaging portion moves in a direction apart from the second engaged portion upon receiving force of the movement of the first engaging portion to disengage the second engaging portion from the second engaged portion.

7. The sheet containing device according to claim 4, wherein the first and second engaging portions are structured so that after the second engaging portion disengages from the second engaged portion according to movement of the second engaging portion in a direction apart from the second engaged portion upon reception of external force, the first engaging portion moves in a direction apart from the first engaged portion upon receiving force of the movement of the second engaging portion to disengage the first engaging portion from the first engaged portion.

8. The sheet containing device according to claim 4, further comprising a second urging member for urging the second engaging portion toward the second engaged portion.

9. The sheet containing device according to claim 3, further comprising a first urging member for urging the first engaging portion toward the first engaged portion.

10. An image forming apparatus comprising:

a sheet containing device according to claim 3;

a sheet feeding unit for feeding the sheet contained in the sheet containing device; and an image forming unit for forming an image on the sheet fed by the sheet feeding unit.

11. A sheet containing device comprising:

a sheet containing unit for containing a sheet;

a regulation member arranged movably in a prescribed moving direction with respect to the sheet containing unit for regulating a position of the sheet contained in the sheet containing unit in the moving direction;

first and second engaging portions provided at the regulation member; and first and second engaged portions provided at the sheet containing unit for holding the regulation member at plural holding positions in the moving direction by engaging the first and second engaging portions, respectively, wherein the first and second engaging portions are structured so that after the first engaging portion disengages from the first engaged portion according to movement of the first engaging portion in a direction apart from the first engaged portion upon reception of external force, the second engaging portion moves in a direction apart from the second engaged portion upon receiving force of the movement of the first engaging portion to disengage the second engaging portion from the second engaged portion.

12. The sheet containing device according to claim 11, wherein either one of the first engaging portion and the first engaged portion has a plurality of engagement grooves arranged in having the same interval in the moving direction, wherein the other one of the first engaging portion and the first engaged portion has a plurality of engagement projections arranged in having the same interval in the moving direction engaging the plural engagement grooves, wherein the second engaged portion has one or more engagement holes at respective positions corresponding to standard sizes of one or more kinds, and wherein the second engaging portion has engagement projection or projections engaging one or more of the engagement holes.

13. The sheet containing device according to claim 11, wherein either one of the second engaging portion and the second engaged portion has a plurality of engagement grooves arranged in having the same interval in the moving direction, wherein the other one of the second engaging portion and the second engaged portion has a plurality of engagement projections arranged in having the same interval in the moving direction engaging the plural engagement grooves, wherein the first engaged portion has one or more engagement holes at respective positions corresponding to standard sizes of one or more kinds, and wherein the first engaging portion has engagement projection or projections engaging one or more of the engagement holes.

14. An image forming apparatus comprising:

the sheet containing device as set forth in claim 11;

a sheet feeding unit for feeding the sheet contained in the sheet containing device; and an image forming unit for forming an image on the sheet fed by the sheet feeding unit.

15. The sheet containing device according to claim 11, further comprising:

a lever rotating around a fulcrum, the lever including an operation point portion at one end of the fulcrum, wherein the lever rotates and the operation point portion contacts a first engaging portion, and wherein when the lever further rotates, the first engaging portion linearly moves and separates from the first engaged portion.

16. The sheet containing device according to claim 15, wherein each of the first and second engaging portions has a contact portion, and wherein the contact portion of the first and second engaging portions are separated from each other where both of the first and second engaging portions are engaged, and when either one of the first and second engaging portions moves according to external force, the contact portion of the one of the engaging portions provides force from the move upon contacting the contact portion of the other engaging portion of the first and second engaging portions after the one engaging portion is disengaged.

17. The sheet containing device according to claim 15, wherein any one of the move of the first engaging portion and the move of the second engaging portion is a liner movement.

18. The sheet containing device according to claim 15, further comprising a lever pivotally provided at the regulation member for providing external force to either one of the first and second engaging portions upon pivotal movement in receiving a controlling force.

19. The sheet containing device according to claim 15, wherein the lever includes an effort point receiving a controlling force on another end of the fulcrum.

20. The sheet containing device according to claim 19, wherein the lever is structured to receive force exerted in a direction parallel to the moving direction as the controlling force.

21. The sheet containing device according to claim 19, further comprising a second urging member for urging the second engaging portion toward the second engaged portion.

22. The sheet containing device according to claim 19, further comprising a first urging member for urging the first engaging portion toward the first engaged portion.

* * * * *